US009666132B2

(12) United States Patent
Wu et al.

(10) Patent No.: US 9,666,132 B2
(45) Date of Patent: May 30, 2017

(54) PIXEL CIRCUIT, METHOD FOR DRIVING THE SAME AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Bo Wu, Beijing (CN); Xiaojing Qi, Beijing (CN); Wen Tan, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 0 days.

(21) Appl. No.: 14/771,374

(22) PCT Filed: Oct. 16, 2014

(86) PCT No.: PCT/CN2014/088753

§ 371 (c)(1),
(2) Date: Aug. 28, 2015

(87) PCT Pub. No.: WO2016/011711

PCT Pub. Date: Jan. 28, 2016

(65) Prior Publication Data

US 2016/0365032 A1 Dec. 15, 2016

(30) Foreign Application Priority Data

Jul. 21, 2014 (CN) ..... 2014 1 0347862

(51) Int. Cl.

| | |
|---|---|
| ***G09G 3/3258*** | (2016.01) |
| ***G09G 3/3291*** | (2016.01) |
| ***G09G 3/3233*** | (2016.01) |

(52) U.S. Cl.
CPC ..... *G09G 3/3258* (2013.01); *G09G 3/3233* (2013.01); *G09G 3/3291* (2013.01);
(Continued)

(58) Field of Classification Search
CPC .... G09G 3/3233; G09G 3/3241; G09G 3/325; G09G 3/3258; G09G 3/3208;
(Continued)

(56) References Cited

U.S. PATENT DOCUMENTS 5,990,629 A 11/1999 Yamada et al.
6,937,215 B2 8/2005 Lo
(Continued)

FOREIGN PATENT DOCUMENTS

CN 1494048 A 5/2004
CN 1790468 A 6/2006
(Continued)

OTHER PUBLICATIONS

First Office Action regarding Chinese application No. 201410347862.1, dated Nov. 30, 2015. Translation provided by Dragon Intellectual Property Law Firm.
(Continued)

*Primary Examiner* — Grant Sitta
*Assistant Examiner* — Amen Bogale
(74) *Attorney, Agent, or Firm* — Harness, Dickey & Pierce, P.L.C.

(57) ABSTRACT

The present disclosure discloses a pixel circuit, a method for driving the pixel circuit and a display apparatus. The pixel circuit comprises multiple rows of pixel units and a row sharing unit. Each row of pixel units includes a plurality of sub-pixel units, and each sub-pixel unit includes a light-emitting element. The row sharing unit includes a plurality of row-driving light-emitting control modules. The plurality of sub-pixel units comprised in each row of pixel units is
(Continued)

connected to a corresponding signal line. Each row-driving light-emitting control modules is connected to a light-emitting control signal. Each row-driving light-emitting control module is connected to each sub-pixel unit comprised in a corresponding row of pixel units through the signal line, so as to drive the light-emitting element comprised in the sub-pixel unit to emit light under the control of the light-emitting control signal.

11 Claims, 4 Drawing Sheets

(52) U.S. Cl.
CPC ..... *G09G 2300/043* (2013.01); *G09G 2300/0465* (2013.01); *G09G 2300/0809* (2013.01); *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2320/043* (2013.01)

(58) Field of Classification Search
CPC ..... G09G 3/3225; G09G 3/3291; G09G 2300/0819; G09G 2300/0842; G09G 2300/08; G09G 2300/043; G09G 2300/0465; G09G 2300/0861; G09G 2300/0852; G09G 2300/0876; G09G 2310/0256; G09G 2310/0262; G09G 2320/043; G09G 2320/045; G09G 2320/0233; G09G 2300/0439; G09G 2300/0404; G09G 2300/0408; G09G 2300/0809; G09G 2300/0814; G09G 2300/0421; G09G 2300/0426; G09G 2310/06; G09G 2310/061; G09G 2310/062; G09G 2310/063; G09G 2310/065; G09G 2310/0264; G09G 2310/0272; G09G 2310/02; G09G 2310/0202; G09G 2310/0245; G09G 2310/0278; G09G 2310/0267; G09G 2320/0204
See application file for complete search history.

(56) References Cited

U.S. PATENT DOCUMENTS

| | | | | |
|---|---|---|---|---|
| 2004/0174354 | A1* | 9/2004 | Ono | G09G 3/3233 345/204 |
| 2005/0280616 | A1* | 12/2005 | Miwa | G09G 3/3233 345/77 |
| 2007/0063932 | A1* | 3/2007 | Nathan | G09G 3/3233 345/76 |
| 2011/0193768 | A1* | 8/2011 | Choi | G09G 3/3233 345/76 |
| 2012/0120042 | A1* | 5/2012 | Tsai | G09G 3/3233 345/211 |
| 2013/0175941 | A1* | 7/2013 | Wu | H05B 33/0896 315/226 |
| 2015/0199932 | A1* | 7/2015 | Ohara | G09G 3/3233 345/212 |

FOREIGN PATENT DOCUMENTS

| | | | | |
|---|---|---|---|---|
| CN | 103165080 | A | 6/2013 | |
| CN | 103531151 | A | 1/2014 | |
| CN | 103578411 | A | 2/2014 | |
| CN | 103714778 | A | 4/2014 | |
| CN | 104036724 | A | 9/2014 | |
| JP | WO 2014021158 | A1 * | 2/2014 | G09G 3/3233 |
| KR | 20080080753 | A | 9/2008 | |
| KR | 20130087128 | A | 8/2013 | |

OTHER PUBLICATIONS

Written Opinion of the International Searching Authority for international application No. PCT/CN2014/088753.

* cited by examiner

PIXEL CIRCUIT, METHOD FOR DRIVING THE SAME AND DISPLAY APPARATUS

CROSS-REFERENCE TO RELATED APPLICATIONS

This application is the U.S. national phase of PCT Application No. PCT/CN2014/088753 filed on Oct. 16, 2014, which claims a priority of the Chinese Patent Application No. 201410347862.1 filed on Jul. 21, 2014, the disclosures of which are incorporated in their entirety by reference herein.

TECHNICAL FIELD

The present disclosure relates to the field of display technology, in particular to a pixel circuit, a method for driving the pixel circuit and a display apparatus.

BACKGROUND

For a Low Temperature Poly-Silicon (LTPS) based Active Matrix Organic Light-Emitting Diode (AMOLED) pixel driving circuit, since the LTPS has a problem of poor threshold voltage uniformity, in the pixel design of AMOLED, it requires to add a circuit that compensates for a threshold voltage of a driving thin film transistor (TFT).

As shown in FIG. 1A, a common design of an AMOLED pixel driving circuit having a threshold voltage compensation function requires a 6T1C pixel driving circuit, or requires more TFTs and/or capacitors. As shown in FIG. 1A, the 6T1C pixel driving circuit comprises a first control transistor T1, a second control transistor T2, a third control transistor T3, a fourth control transistor T4, a fifth control transistor T5, a storage capacitor Cs and a driving transistor DTFT, and is configured to drive an organic light-emitting diode OLED; gate electrodes of T1, T3 and T4 are connected to a first scan voltage VSCAN1, gate electrodes of T2 and T5 are connected to a second scan voltage VSCAN2, T1 is further connected to a data voltage Vdata, a first terminal of Cs is marked as A, a second terminal of Cs is marked as B, a node connecting T2, T3 with a gate electrode of DTFT is marked as C, an anode of OLED is connected to a high level VDD, and one terminal of T5 is connected to a low level VSS.

As shown in FIG. 1B, the existing pixel circuit comprises L rows of pixel units, each row of pixels units comprises M 6T1C sub-pixel units, and each 6T1C sub-pixel unit comprises a 6T1C pixel driving unit and a light-emitting element, where L and M are positive integers greater than 2, n is a positive integer greater than 1 and smaller than L, and n is smaller than M, Gate_1 is a first gate line, Gate_n−1 is an (n−1)-th gate line, Gate_n is an n-th gate line, Gate_L is an L-th gate line, Data_1 is a first data line, Data_n−1 is an (n−1)-th data, Data_n is an n-th data line, and Data_M is an M-th data line.

In the related art, the number of TFTs and/or capacitors would be increased due to the need of compensation for the threshold voltage, such that more control signals are required and a larger wiring space is occupied, which is disadvantageous for the reduction of AMOLED pixel size, i.e., limiting development of the AMOLED pixel driving circuit having a high PPI (Pixel per Inch).

SUMMARY

A major purpose of the present disclosure is to provide a pixel circuit, a method for driving the same and a display apparatus, which is capable of increasing aperture ratio of pixels, so that uniform display is ensured and at the same time current density of an organic light-emitting layer is reduced.

There is provided in the present disclosure a pixel circuit, comprising multiple rows of pixel units and a row sharing unit, wherein each row of pixel units includes a plurality of sub-pixel units each of which includes a light-emitting element, and the row sharing unit includes a plurality of row-driving light-emitting control modules;

wherein the plurality of sub-pixel units included in each row of pixel units is connected to a corresponding signal line;

each row-driving light-emitting control module is connected to a light-emitting control signal; and each row-driving light-emitting control module is connected to each sub-pixel unit included in a corresponding row of pixel units through the signal line, so as to drive the light-emitting element included in the sub-pixel unit to emit light under the control of the light-emitting control signal.

Alternatively, the sub-pixel unit is arranged within an effective display area, and the row sharing unit is arranged outside the effective display area.

Alternatively, each sub-pixel unit included in pixel units in an n-th row comprises a sub-pixel driving circuit, where n is a positive integer and n is smaller than or equal to the total number of rows of pixel units comprised in the pixel circuit;

the sub-pixel driving circuit comprises a driving compensation module, a data writing module and a driving transistor;

the driving transistor has a first electrode connected to a first terminal of the light-emitting element, and a second electrode connected to a first level; a second terminal of the light-emitting element is connected to the signal line;

the driving compensation module is connected to an n-th scanning line, a gate electrode of the driving transistor, the first electrode of the driving transistor and the second electrode of the driving transistor respectively, and is configured to control a gate-source voltage of the driving transistor to compensate for a threshold voltage of the driving transistor when a scanning signal outputted by the n-th scanning line is effective;

the data writing module is connected to the n-th scanning line, a data line and the driving compensation module respectively, and is configured to control a data voltage of the data line to be written into the gate electrode of the driving transistor through the driving compensation module when the scanning signal outputted by the n-th scanning line is effective; and each row-driving light-emitting control module is connected to the light-emitting control signal and a second level respectively, is connected to the second terminal of the light-emitting element through the signal line, and is configured to control a potential of the signal line to be the second level when the light-emitting control signal is effective.

The driving compensation module is further configured to control and maintain the gate-source voltage of the driving transistor and control the driving transistor to drive the light-emitting element to emit light when the light-emitting control signal is effective and the scanning signal outputted by the n-th scanning line is ineffective.

Alternatively, the driving compensation module comprises a first compensating transistor, a second compensating transistor and a storage capacitor;

wherein the first compensating transistor has a gate electrode connected to the n-th scanning line, a first electrode connected to the gate electrode of the driving transistor, and a second electrode connected to a first terminal of the storage capacitor;

a second terminal of the storage capacitor is connected to the first electrode of the driving transistor; and the second compensating transistor has a gate electrode connected to the n-th scanning line, a first electrode connected to the first electrode of the first compensating transistor, and a second electrode connected to the second electrode of the driving transistor.

Alternatively, the data writing module comprises: a data writing transistor, whose gate electrode is connected to the n-th scanning line, first electrode is connected to the data line, and second electrode is connected to the first terminal of the storage capacitor.

Alternatively, each row-driving light-emitting control module comprises: a row-driving light-emitting control transistor, whose gate electrode is connected to the light-emitting control signal, first electrode is connected to the second level, and second electrode is connected to the signal line.

Alternatively, the driving transistor, the second compensating transistor, the data writing transistor and the row-driving light-emitting control transistor are n-type thin film transistors (TFTs), and the first compensating transistor is a p-type TFT.

Alternatively, the light-emitting element is an organic light-emitting diode.

There is further provided in the present disclosure a method for driving the above pixel circuit, comprising:

a threshold compensating and data writing step:

enabling a scanning signal outputted by a present scanning line to be effective and a light-emitting control signal to be ineffective, controlling by a driving compensation module a gate-source voltage of a driving transistor to compensate for a threshold voltage of the driving transistor, controlling by a data writing module a data voltage of a data line to be written into a gate electrode of the driving transistor through the driving compensation module; and turning off a row-driving light-emitting control module so that a signal line is in a floating state, and a light-emitting element has no connecting path;

a buffering step:

enabling both the scanning signal outputted by the present scanning line and the light-emitting control signal to be ineffective, and the gate electrode of the driving transistor to be in a floating state, controlling and maintaining, by the driving compensation module, the gate-source voltage of the driving transistor, and at the same time, disconnecting from the data writing module; and a light-emitting step:

enabling the light-emitting signal to be effective and the scanning signal outputted by the present scanning line to be ineffective, controlling, by the row-driving light-emitting control module, a potential of the signal line to be a second level, and controlling and maintaining the gate-source voltage of the driving transistor, and controlling the driving transistor to drive the light-emitting element to emit light, by the driving compensation module.

There is further provided in the present disclosure a display apparatus, comprising the pixel circuit described above.

Compared with the related art, the pixel circuit of the present disclosure adopts the row sharing unit, such that the threshold voltage of the driving transistor can be compensated and at the same time the number of TFTs within the effective display area is reduced. Also, the control signal adopted by the pixel circuit of the present disclosure is simple, so that the aperture ratio of pixels is increased, uniform display is ensured and meanwhile a current density of the organic light-emitting layer is reduced, thereby prolonging the service life of the AMOLED panel.

DETAILED DESCRIPTION

Figure 1A:
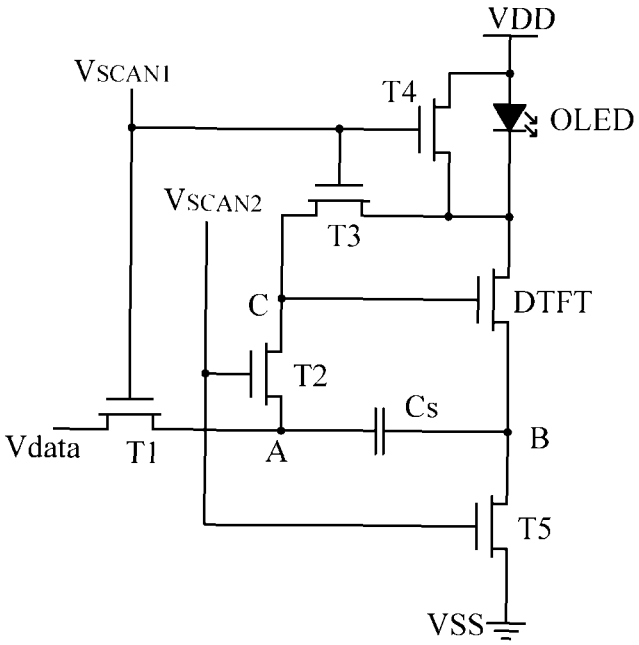
FIG. 1A is a circuit diagram of an existing 6T1C pixel driving circuit.
Figure 1B:
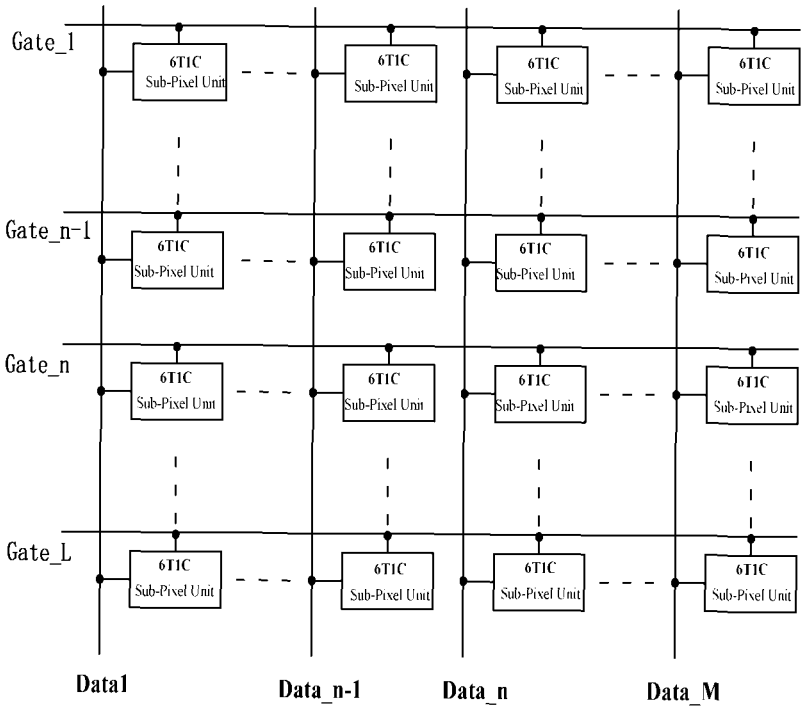
FIG. 1B is a block diagram of a configuration of an existing pixel circuit.

Technical solutions of embodiments of the present disclosure will be described below clearly and completely by combining with accompanying figures in the embodiments of the present disclosure. Obviously, the embodiments described below are just a part of embodiments of the present disclosure, but not all the embodiments thereof. Based on the embodiments of the present disclosure, all the other embodiments obtained by those skilled in the art without paying any inventive work will fall within the protection scope of the present disclosure.

Transistors adopted in all the embodiments of the present disclosure can be thin film transistors or field effect transistors or other devices having the same characteristics. In the embodiments of the present disclosure, in order to distinct two electrodes other than a gate electrode of a transistor, a first electrode can be a source electrode or a drain electrode, and a second electrode can be a drain electrode or a source electrode. In addition, transistors can be divided into n-type transistors or p-type transistors according to their characteristics. In a driving circuit provided in the embodiments of the present disclosure, it can be conceived that either adopting the n-type transistors or adopting the p-type transistors is easily conceivable for those skilled in the art without paying any inventive labor, and thus they should fall within the protection scope of the present disclosure.

The pixel circuit described in an embodiment of the present disclosure comprises multiple rows of pixel units, each row of pixel units including a plurality of sub-pixel units, and each sub-pixel unit including a light-emitting element. The pixel circuit further comprises a row sharing unit, which includes a plurality of row-driving light-emitting control modules. The plurality of sub-pixel units included in each row of pixel units is connected to a corresponding signal line. Each row-driving light-emitting control module is connected to a light-emitting control signal. Each row-driving light-emitting control module is connected to each sub-pixel unit included in a corresponding row of pixel units through the signal line, so as to drive the light-emitting element to emit light under the control of the light-emitting control signal.

In a specific implementation, each sub-pixel unit comprises a sub-pixel driving circuit and a light-emitting element. The light-emitting element can be for example an organic light-emitting diode (OLED).

The pixel circuit provided in the embodiment of the present disclosure adopts the row sharing unit, such that the threshold voltage of the driving transistor can be compensated and at the same time the number of TFTs within the effective display area is reduced. Also, the control signal adopted by the pixel circuit of the present disclosure is simple, so that the aperture ratio of pixels is increased, the uniform display is ensured and meanwhile the current density of the organic light-emitting layer is reduced, thereby prolonging the service life of the AMOLED panel.

Alternatively, the sub-pixel unit is arranged within an effective display area, and the row sharing unit is arranged outside the effective display area. By arranging the circuit having a common characteristic in each row of pixel units outside the effective display area, the number of TFTs within the effective display area is further reduced and the aperture ratio is increased.

Alternatively, each sub-pixel unit included in pixel units in an n-th row comprises a sub-pixel driving circuit and a light-emitting element, where n is a positive integer and n is smaller than or equal to the total number of rows of pixel units comprised in the pixel circuit.

The sub-pixel driving circuit comprises a driving compensation module, a data writing module and a driving transistor.

The driving transistor has a first electrode connected to a first terminal of the light-emitting element and a second electrode connected to a first level; a second terminal of the light-emitting element is connected to the signal line.

The driving compensation module is connected to an n-th scanning line, a gate electrode of the driving transistor, the first electrode of the driving transistor and the second electrode of the driving transistor respectively, and is configured to, in a first stage during a period of time, control a gate-source voltage of the driving transistor to compensate for a threshold voltage of the driving transistor when a scanning signal outputted by the n-th scanning line is effective.

The data writing module is connected to the n-th scanning line, a data line and the driving compensation module respectively, and is configured to control a data voltage of the data line to be written into the gate electrode of the driving transistor through the driving compensation module when the scanning signal outputted by the n-th scanning line is effective.

Each row-driving light-emitting control module is connected to a light-emitting control signal and a second level respectively, is connected to the second terminal of the light-emitting element through the signal line, and is configured to control a potential of the signal line to be the second level when the light-emitting control signal is effective.

The driving compensation module is further configured to control and maintain the gate-source voltage of the driving transistor and control the driving transistor to drive the light-emitting element to emit light when the light-emitting control signal is effective and the scanning signal outputted by the n-th scanning line is ineffective.

In particular, the pixel circuit provided in the embodiment of the present disclosure comprises L rows of pixel units, each of which includes M sub-pixel units; the M sub-pixel units included in the pixel units in the n-th row are connected to a n-th scanning line; a k-th sub-pixel unit included in each row of pixel units is connected to a k-th data line; where L and M are integer greater than 1, n is a positive integer smaller than or equal to L, and k is a positive integer smaller than or equal to M.

Figure 2:
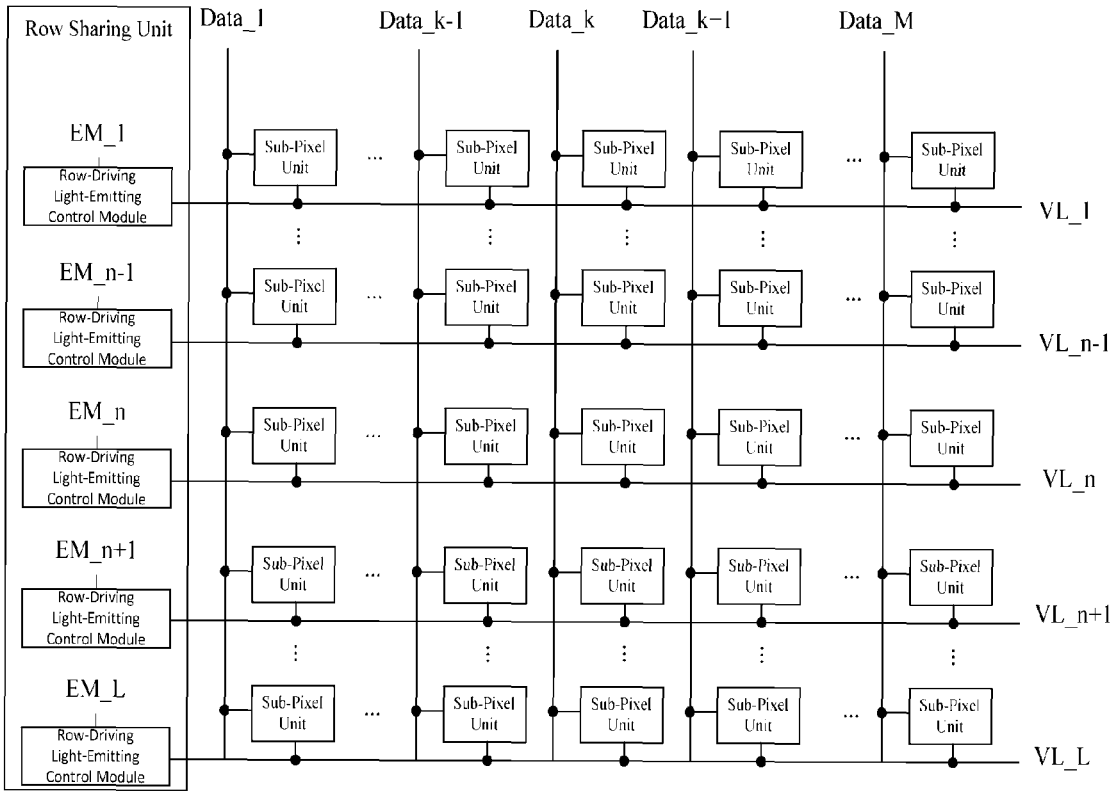
FIG. 2 is a schematic diagram of a configuration of a pixel circuit in an embodiment of the present disclosure.

As shown in FIG. 2, Data_1 is a first data line, Data_k−1 is an (k−1)-th data line, Data_k is a k-th data line, Data_k+1 is a (k+1)-th data line, and Data_M is an M-th data line.

In FIG. 2, VL_1 is a signal line connected to a plurality of sub-pixel units included in pixel units in the first row; VL_n−1 is a signal line connected to a plurality of sub-pixel units included in pixel units in the (n−1)-th row, VL_n is a signal line connected to a plurality of sub-pixel units included in pixel units in the n-th row, VL_n+1 is a signal line connected to a plurality of sub-pixel units included in pixel units in the (n+1)-th row, and VL_L is a signal line connected to a plurality of sub-pixel units included in pixel units in the L-th row.

In this embodiment, in the pixel circuit as shown in FIG. 2, each sub-pixel unit is a 4T1C sub-pixel unit.

In particular, the description is provided below by taking a connection between a row-driving light-emitting control module included in the row sharing unit and a sub-pixel unit included in the pixel units in the n-th row as an example.

Figure 3:
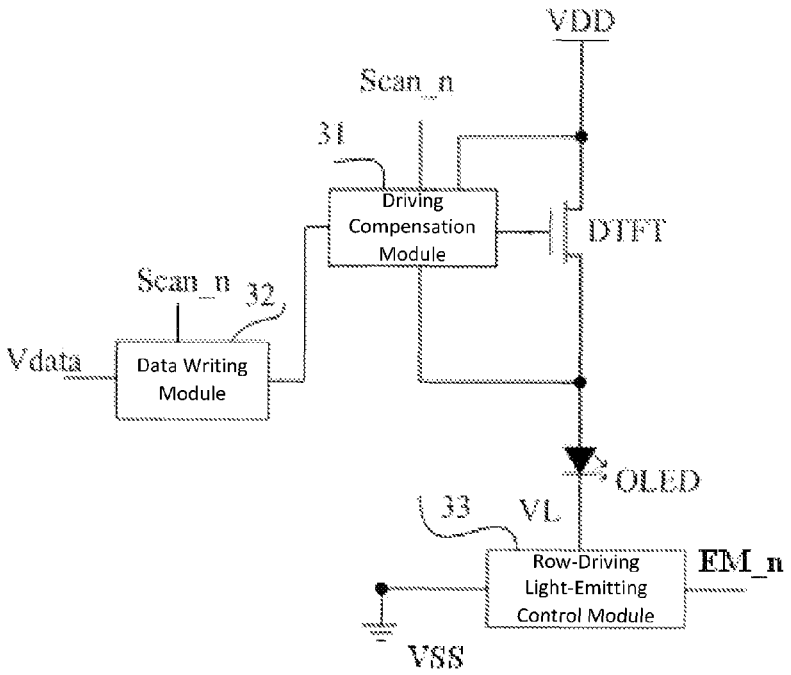
FIG. 3 is a block diagram of configurations of sub-pixel units and row-driving light-emitting control modules connected with each other and comprised in a pixel circuit in an embodiment of the present disclosure.

As shown in FIG. 3, the sub-pixel unit includes a sub-pixel driving circuit and an organic light-emitting diode OLED. The sub-pixel driving circuit includes a driving transistor DTFT, a driving compensation module 31 and a data writing module 32;

A data line Data outputs a data voltage Vdata.

The driving transistor DTFT has a first electrode connected to an anode of OLED, and a second electrode connected to a high level VDD.

A cathode of OLED is connected to a signal line VL.

The driving compensation module 31 is connected to a n-th scanning line Scan_n, a gate electrode of the driving transistor DTFT, the first electrode of the driving transistor DTFT, and the second electrode of the driving transistor DTFT respectively, and is configured to control a gate-source voltage of the driving transistor DTFT to compensate for a threshold voltage Vth of the driving transistor DTFT when a scanning signal outputted by the n-th scanning line Scan_n is effective.

The data writing module 32 is connected to a n-th scanning line Scan_n, the data line Data and the driving compensation module 31 respectively, and is configured to control the data voltage Vdata of the data line Data to be written into the gate electrode of the driving transistor DTFT through the driving compensation module 31 when the scanning signal outputted by the n-th scanning line Scan_n is effective.

Each row-driving light-emitting control module 33 is connected to a light-emitting control signal EM_n and a low level VSS respectively, is connected to the cathode of OLED through the signal line VL, and is configured to control over the potential of the signal line VL to be the low level VSS when the light-emitting control signal EM_n is effective.

The driving compensation module 31 is further configured to control and maintain the potential at the gate electrode of the driving transistor DTFT and control the driving transistor DTFT to drive OLED to emit light when the light-emitting control signal EM_n is effective and the scanning signal outputted by the n-th scanning line Scan_n are ineffective.

In the specific embodiment as shown in FIG. 3, DTFT is an n-type TFT. However, it should be understood that the type of DTFT is not limited thereto. Also, DTFT can be a p-type TFT.

In an embodiment, the driving compensation module comprises a first compensating transistor, a second compensating transistor and a storage capacitor;

The first compensating transistor has a gate connected to the n-th scanning line, a first electrode connected to the gate electrode of the driving transistor, and a second electrode connected to a first terminal of the storage capacitor;

The second compensating transistor has a gate connected to the n-th scanning line, a first electrode connected to the first electrode of the first compensating transistor, and a second electrode connected to the second electrode of the driving transistor;

The storage capacitor has a second terminal connected to the first electrode of the driving transistor.

Figure 4:
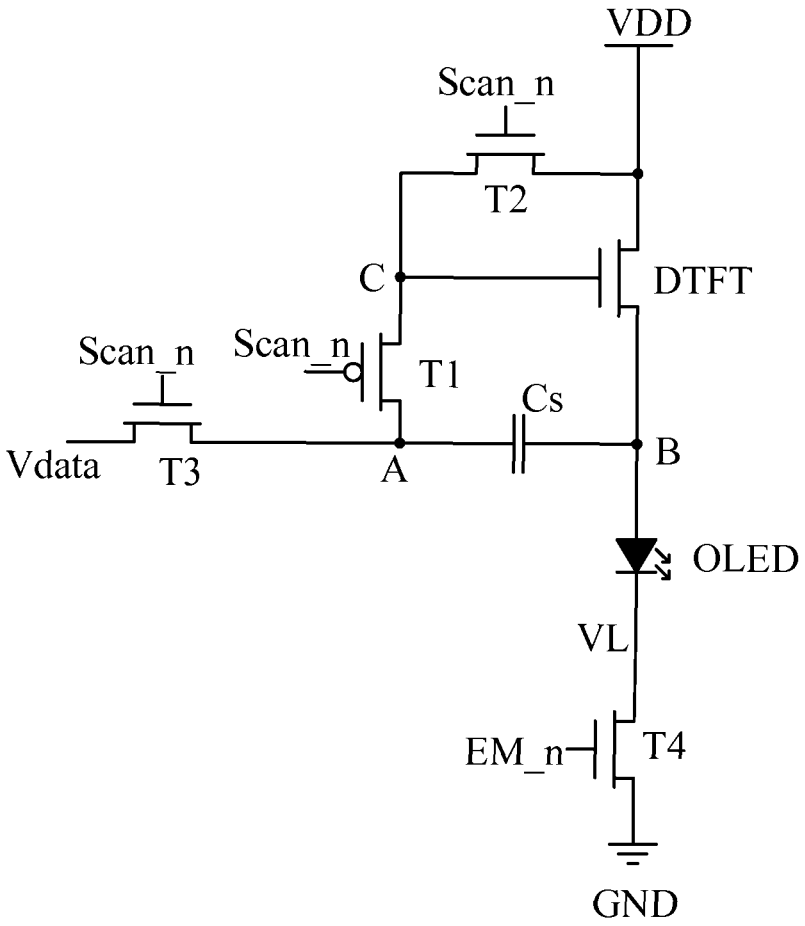
FIG. 4 is a circuit diagram of sub-pixel units and row-driving light-emitting control modules connected with each other and comprised in a pixel circuit in an embodiment of the present disclosure.

In particular, as shown in FIG. 4, the first electrode of the driving transistor DTFT is connected to the anode of OLED, and the second electrode thereof is connected to the high level VDD; the cathode of OLED is connected to the signal line VL.

The low level VSS can be a ground level GND.

The driving compensation module can comprise a first compensating transistor T1, a second compensating transistor T2 and a storage capacitor Cs;

The first compensating transistor T1 has a gate connected to the n-th scanning line Scan_n, a first electrode connected to the gate electrode of the driving transistor DTFT, and a second electrode connected to a first terminal A of the storage capacitor Cs;

The storage capacitor Cs has a second terminal B connected to the first electrode of the driving transistor DTFT;

The second compensating transistor T2 has a gate connected to the n-th scanning line Scan_n, a first electrode connected to the first electrode of the first compensating transistor T1, and a second electrode connected to the second electrode of the driving transistor DTFT.

The data writing module may includes: a data writing transistor T3, whose gate is connected to the n-th scanning line Scan_n, first electrode is connected to the data line Data, and second electrode is connected to the first terminal A of the storage capacitor Cs.

Each row-driving light-emitting control module can comprise: a row-driving light-emitting control transistor T4, whose gate is connected the light-emitting control signal EM_n, first electrode is connected to the ground level GND, and second electrode is connected to the signal line VL.

In FIG. 4, node C is a node connected to the gate electrode of the driving transistor DTFT. DTFT, T2, T3 and T4 are n-type TFTs, and T1 is a p-type TFT.

In the embodiment as shown in FIG. 4, the sub-pixel unit including DTFT, T1, T2, T3, Cs and OLED is arranged within the effective display area, the row-driving light-emitting control module including T4 is arranged outside the effective display area, and the plurality of sub-pixel units of a same row of pixel units are connected to a corresponding row-driving light-emitting control module, so as to have the threshold voltage compensation function.

In a specific implementation, it is not limited to the embodiment described above. The purpose of reducing the number of TFTs within the effective display area can be achieved as long as the row sharing unit including the plurality of row-driving light-emitting control modules is adopted, so that the pixel size can be reduced.

Figure 5:
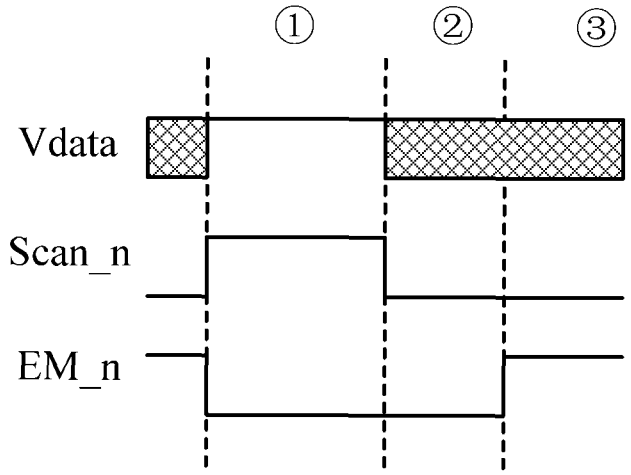
FIG. 5 is an operation timing diagram of the pixel circuit comprising the sub-pixel units and row-driving light-emitting control module connected with each other as shown in FIG. 4.

An operation timing of the embodiment as shown in FIG. 4 is as shown in FIG. 5, and is divided into three stages.

Figure 6A:
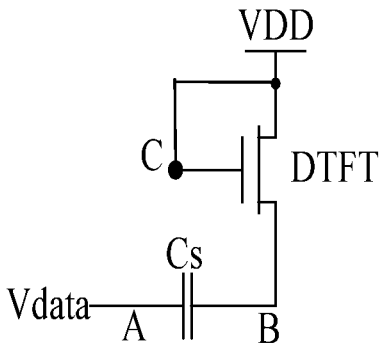
FIGS. 6A, 6B and 6C are equivalent circuit diagrams of the circuit as shown in FIG. 4 in a first stage, a second stage and a third stage respectively.
Figure 6B:
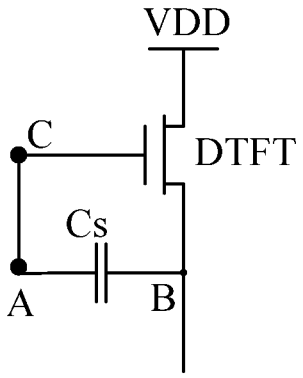
Figure 6C:
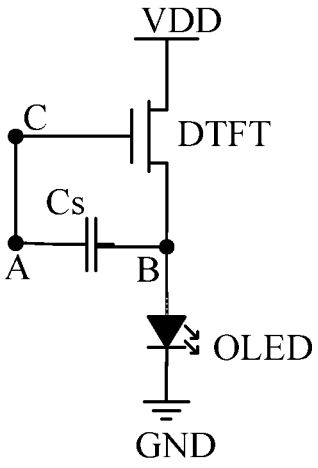

In a first stage (i.e., a threshold voltage compensating and data voltage writing stage): Scan_n outputs a high level, EM_n outputs a low level, and thus the shared row-driving light-emitting control transistor T4 is turned off, the VL of the sub-pixel driving circuit is in a floating state, and OLED has no connecting path. Scan_n is of a high level, and thus T2 and T3 are turned on, and T1 is turned off. The equivalent circuit of the sub-pixel driving circuit is as shown in FIG. 6A. At this time, DTFT is a diode entering into a saturation state, the data voltage Vdata is written, the potential VA at the first terminal A of Cs is Vdata, the potential VB at the second terminal B of Cs is VDD-Vth, and a difference value between the potential at the first terminal A of Cs and the potential at the second terminal B of Cs VCs=VA−VB=Vdata−VDD+Vth;

In a second stage (i.e., a buffering stage): Scan_n outputs a low level, EM_n outputs a low level, and thus T4 is turned off, the signal line VL is in a floating state, and OLED has no connecting path; Scan_n is of a low level, and thus T2 and T3 are turned off, and T1 is turned on. The equivalent circuit of the sub-pixel circuit is as shown in FIG. 6B; no voltage is inputted from the data line, the gate electrode of the DTFT is floated, the terminal A of Cs is connected to the node C (the node connected to the gate electrode of DTFT), Cs has no path for charging or discharging, the voltage cross the two terminals of Cs maintains unchanged, the potential VC at the node C is equal to VA, and the gate-source voltage of DTFT Vgs=VCB=VAB=VCs=Vdata−VDD+Vth;

In a third stage (i.e., a light-emitting stage): Scan_n outputs a low level, EM_n outputs a high level, and thus T4 is turned on, and the signal line VL is grounded through T4, so that DTFT and OLED form a connecting path. The equivalent circuit of the sub-pixel driving circuit is as shown in FIG. 6C. T2 and T3 are turned off, T1 is turned on, and Cs has no path for charging or discharging. Therefore, the voltage cross the two terminals of Cs maintains unchanged, that is, the gate-source voltage of DTFT maintains unchanged, Vgs=Vdata−VDD+Vth, and thus the current flowing through OLED $I=K\ (Vdata-VDD)^2$, where K is a constant related to process and design. In this way, the influence of non-uniformity and drift of Vth of DTFT is eliminated, and at the same time the influence of degradation of the turn-on voltage Vth_oled of OLED is eliminated, so that current uniformity is improved and luminance uniformity is achieved;

At the same time, the control signal in the sub-pixel driving circuit is simple, a part of TFTs are shared, the basic sub-pixel unit is a 4T1C sub-pixel unit, and the row-driving light-emitting control transistor is shared, so that the function of compensating for the threshold voltage is realized through fewer TFTs and simple control signals, and meanwhile the pixel circuit is simplified.

There is further provided in the present disclosure a method for driving the above pixel circuit, including:

a threshold compensating and data writing step:

enabling a scanning signal outputted by a present scanning line to be effective (for example, of a high level) and a light-emitting control signal to be ineffective (for example, of a low level), controlling by a driving compensation module a gate-source voltage of a driving transistor to compensate for a threshold voltage of the driving transistor, controlling by a data writing module a data voltage of a data line to be written into a gate electrode of the driving transistor through the driving compensation module; and turning off a row-driving light-emitting control module so that a signal line is in a floating state, and a light-emitting element has no connecting path;

a buffering step:

enabling both the scanning signal outputted by the present scanning line and the light-emitting control signal to be ineffective, and the gate electrode of the driving transistor to be in a floating state, controlling and maintaining, by the driving compensation module, the gate-source voltage of the driving transistor, and at the same time, disconnecting from the data writing module; and a light-emitting step:

enabling the light-emitting signal to be effective and the scanning signal outputted by the present scanning line to be ineffective, controlling, by the row-driving light-emitting control module, a potential of the signal line to be a second level, and controlling and maintaining the gate-source voltage of the driving transistor, and controlling the driving transistor to drive the light-emitting element to emit light, by the driving compensation module.

There is further provided a display apparatus in an embodiment of the present disclosure, including the pixel circuit described above. The display apparatus can comprise a liquid crystal display apparatus, for example, a liquid crystal panel, a liquid crystal television, a mobile phone and a liquid crystal display. Besides the liquid crystal display apparatus, the display apparatus can further comprise an organic display or other types of display apparatuses, such as an electronic reader and so on.

The above description is just for illustration but not for limitation. A person skilled in the art should understand that various amendments, alternations or equivalents can be made without departing the spirit and scope defined in the claims. These amendments, alternations or equivalents should fall within the protection scope of the present disclosure.

What is claimed is:

1. A pixel circuit comprising:

multiple rows of pixel units, wherein each of the rows of pixel units comprises a plurality of sub-pixel units, and wherein each of the plurality of sub-pixel units comprises a light-emitting element; and a row sharing circuit comprising a plurality of row-driving light-emitting control circuits, wherein the plurality of sub-pixel units comprised in each of the rows of pixel units is connected to a corresponding signal line, each of the row-driving light-emitting control circuits is configured to receive a light-emitting control signal, each of the row-driving light-emitting control circuits is connected to each of the sub-pixel units comprised in a corresponding one of the rows of pixel units via a corresponding one of signal lines to drive the light-emitting element comprised in a corresponding one of the plurality of sub-pixel units to emit light based on a corresponding one of the light-emitting control signals, each of the sub-pixel units comprised in the pixel units in an n-th row of the pixel units comprises a sub-pixel driving circuit, where n is a positive integer smaller than or equal to a total number of rows of pixel units comprised in the pixel circuit, the sub-pixel driving circuit comprises a driving compensation circuit, a data writing circuit and a driving transistor, the driving transistor has a first electrode connected to a first terminal of a corresponding one of the light-emitting elements and a second electrode at a first potential, a second terminal of the corresponding one of the light-emitting elements is connected to a corresponding one of the signal lines, the driving compensation circuit is connected to an n-th scanning line, a gate electrode of the driving transistor, the first electrode of the driving transistor and the second electrode of the driving transistor, the driving compensation circuit is configured to control a gate-source voltage of the driving transistor to compensate for a threshold voltage of the driving transistor when a scanning signal outputted by the n-th scanning line is effective, the data writing circuit is connected to the n-th scanning line, a data line and the driving compensation circuit, the data writing circuit is configured to control a data voltage of the data line to be written into the gate electrode of the driving transistor through the driving compensation circuit when the scanning signal outputted by the n-th scanning line is effective, each of the row-driving light-emitting control circuits is configured to receive the corresponding one of the light-emitting control signals and is at a second potential, is connected to the second terminal of the light-emitting element through the corresponding one of the signal lines, and is configured to control a potential of the corresponding one of the signal lines to be at the second potential when the corresponding one of the light-emitting control signals is effective, the driving compensation circuit is further configured to control and maintain the gate-source voltage of the driving transistor and control the driving transistor to drive one of the light-emitting elements to emit light when the corresponding one of the light-emitting control signals is effective and the scanning signal outputted by the n-th scanning line is ineffective, the driving compensation circuit comprises a first compensating transistor, a second compensating transistor and a storage capacitor, the first compensating transistor has a gate electrode connected to the n-th scanning line, a first electrode connected to the gate electrode of the driving transistor, and a second electrode connected to a first terminal of the storage capacitor, a second terminal of the storage capacitor is connected to the first electrode of the driving transistor, and the second compensating transistor has a gate electrode connected to the n-th scanning line, a first electrode connected to the first electrode of the first compensating transistor, and a second electrode connected to the second electrode of the driving transistor.

2. The pixel circuit according to claim 1, wherein:

the plurality of sub-pixel units are arranged within an effective display area; and the row sharing circuit is arranged outside the effective display area.

3. The pixel circuit according to claim 1, wherein:

the data writing circuit comprises a data writing transistor; and the data writing transistor comprises a gate electrode connected to the n-th scanning line, a first electrode connected to the data line, and a second electrode connected to the first terminal of the storage capacitor.

4. The pixel circuit according to claim 1, wherein:

each of the row-driving light-emitting control circuits comprises a row-driving light-emitting control transistor; and each of the row-driving light-emitting control transistors comprises a gate electrode configured to receive a corresponding one of the light-emitting control signals, a first electrode at the second potential, and a second electrode connected to the corresponding one of the signal lines.

5. The pixel circuit according to claim 4, wherein:

the driving transistor, the second compensating transistor, the data writing transistor and the row-driving light-emitting control transistors are n-type thin film transistors (TFTs); and the first compensating transistor is a p-type TFT.

6. The pixel circuit according to claim 1, wherein the light-emitting elements are organic light-emitting diodes.

7. A display apparatus, comprising the pixel circuit according to claim 1.

8. The pixel circuit according to claim 7, wherein the data writing circuit comprises:

a data writing transistor;

a gate electrode connected to the n-th scanning line;

a first electrode connected to the data line; and a second electrode is connected to the first terminal of the storage capacitor.

9. The pixel circuit according to claim 7, wherein each row-driving light-emitting control circuit comprises:

a row-driving light-emitting control transistor;

a gate electrode configured to receive a corresponding one of the light-emitting control signals;

a first electrode at the second level; and a second electrode connected to a corresponding one of the signal lines.

10. The pixel circuit according to claim 9, wherein:

the driving transistor, the second compensating transistor, the data writing transistor and the row-driving light-emitting control transistor are n-type thin film transistors (TFTs); and the first compensating transistor is a p-type TFT.

11. A method for driving a pixel circuit, wherein:

the pixel circuit comprises multiple rows of pixel units and a row sharing circuit, wherein each of the rows of pixel units comprises a plurality of sub-pixel units;

each of the plurality of sub-pixel units comprises a light-emitting element;

the row sharing circuit comprises a plurality of row-driving light-emitting control circuits;

the plurality of sub-pixel units comprised in each of the rows of pixel units is connected to a corresponding signal line;

each of the row-driving light-emitting control circuits receives a light-emitting control signal;

each of the row-driving light-emitting control circuits is connected to each of the sub-pixel units comprised in a corresponding one of the rows of pixel units via a corresponding one of the signal lines to drive the light-emitting element comprised in a corresponding one of the plurality of sub-pixel units to emit light based on a corresponding one of the light-emitting control signals;

each of the plurality of sub-pixel units comprised in the pixel units in an n-th row of the pixel units comprises a sub-pixel driving circuit, where n is a positive integer smaller than or equal to a total number of rows of pixel units comprised in the pixel circuit;

the sub-pixel driving circuit comprises a driving compensation circuit, a data writing circuit and a driving transistor;

the driving transistor has a first electrode connected to a first terminal of a corresponding one of the light-emitting elements and a second electrode at a first potential;

a second terminal of the corresponding one of the light-emitting elements is connected to the corresponding one of the signal lines;

the driving compensation circuit is connected to an n-th scanning line, a gate electrode of the driving transistor, the first electrode of the driving transistor and the second electrode of the driving transistor;

the driving compensation circuit is configured to control a gate-source voltage of the driving transistor to compensate for a threshold voltage of the driving transistor when a scanning signal outputted by the n-th scanning line is effective;

the data writing circuit is connected to the n-th scanning line, a data line and the driving compensation circuit;

the data writing circuit is configured to control a data voltage of the data line to be written into the gate electrode of the driving transistor through the driving compensation circuit when the scanning signal outputted by the n-th scanning line is effective;

each of the row-driving light-emitting control circuits is configured to receive the corresponding one of the light-emitting control signals and is at second potential, is connected to the second terminal of the light-emitting element through the corresponding one of the signal lines, and is configured to control a potential of the corresponding one of the signal lines to be at the second potential when the corresponding one of the light-emitting control signals is effective;

the driving compensation circuit is further configured to control and maintain the gate-source voltage of the driving transistor and control the driving transistor to drive one of the light-emitting elements to emit light when the corresponding one of the light-emitting control signals is effective and the scanning signal outputted by the n-th scanning line is ineffective;

the driving compensation circuit comprises a first compensating transistor, a second compensating transistor and a storage capacitor;

the first compensating transistor has a gate electrode connected to the n-th scanning line, a first electrode connected to the gate electrode of the driving transistor, and a second electrode connected to a first terminal of the storage capacitor;

a second terminal of the storage capacitor is connected to the first electrode of the driving transistor; and the second compensating transistor has a gate electrode connected to the n-th scanning line, a first electrode connected to the first electrode of the first compensating transistor, and a second electrode connected to the second electrode of the driving transistor; and the method comprises a threshold compensating and data writing step comprising enabling a scanning signal outputted by a present scanning line to be effective and one of the light-emitting control signals to be ineffective, controlling by the driving compensation circuit a gate-source voltage of the driving transistor to compensate for a threshold voltage of the driving transistor, controlling by the data writing circuit a data voltage of one of the data lines to be written into the gate electrode of the driving transistor through the driving compensation circuit, and turning off one of the row-driving light-emitting control circuits so that one of the signal lines is in a floating state and the corresponding one of the light-emitting elements has no connecting path, a buffering step comprising enabling both the scanning signal outputted by the present scanning line and the corresponding one of the light-emitting control signals to be ineffective, and the gate electrode of the driving transistor to be in a floating state, controlling and maintaining, by the driving compensation circuit, the gate-source voltage of the driving transistor, and at the same time, disconnecting from the data writing circuit, and a light-emitting step:

enabling the corresponding one of the light-emitting signals to be effective and the scanning signal outputted by the present scanning line to be ineffective, controlling, by the corresponding one of the row-driving light-emitting control circuits, a potential of the corresponding one of the signal lines to be at the second potential and controlling and maintaining the gate-source voltage of the driving transistor and controlling the driving transistor to drive the corresponding one of the light-emitting elements to emit light by the driving compensation circuit.

* * * * *